US008448883B2

(12) United States Patent
Wada et al.

(10) Patent No.: US 8,448,883 B2
(45) Date of Patent: May 28, 2013

(54) ELECTROSTATICALLY ATOMIZING DEVICE

(75) Inventors: Sumio Wada, Hikone (JP); Atsushi Isaka, Hikone (JP); Kenji Obata, Hikone (JP); Yutaka Uratani, Hikone (JP); Shousuke Akisada, Hikone (JP); Hiroshi Suda, Takatsuki (JP); Takayuki Nakada, Hikone (JP)

(73) Assignee: Panasonic Corporation, Osaka (JP)

( * ) Notice: Subject to any disclaimer, the term of this patent is extended or adjusted under 35 U.S.C. 154(b) by 191 days.

(21) Appl. No.: 12/303,533

(22) PCT Filed: May 22, 2007

(86) PCT No.: PCT/JP2007/060416

§ 371 (c)(1),
(2), (4) Date: Dec. 4, 2008

(87) PCT Pub. No.: WO2007/142022

PCT Pub. Date: Dec. 13, 2007

(65) Prior Publication Data

US 2009/0179093 A1 Jul. 16, 2009

(30) Foreign Application Priority Data

Jun. 8, 2006 (JP) ..... 2006-160174

(51) Int. Cl.

| | |
|---|---|
| ***B05B 5/00*** | (2006.01) |
| ***B05B 1/08*** | (2006.01) |
| ***B05B 3/04*** | (2006.01) |
| ***B05B 5/025*** | (2006.01) |
| ***F23D 11/32*** | (2006.01) |

(52) U.S. Cl.
USPC ..... 239/690.1; 239/102.1; 239/690; 239/706; 427/483

(58) Field of Classification Search
USPC ..... 239/102.1, 102.2, 690, 690.1, 706, 239/708; 427/483
See application file for complete search history.

(56) References Cited

U.S. PATENT DOCUMENTS 3,281,860 A * 10/1966 Adams et al. ..... 347/75
3,700,169 A * 10/1972 Naydan et al. ..... 239/4

(Continued)

FOREIGN PATENT DOCUMENTS

EP 1 564 779 A2 8/2005
JP 11-267552 A 10/1999

(Continued)

OTHER PUBLICATIONS

International Search Report for the Application No. PCT/JP2007/060416 mailed Sep. 4, 2007.

(Continued)

*Primary Examiner* — Ryan Reis
(74) *Attorney, Agent, or Firm* — McDermott Will & Emery LLP

(57) ABSTRACT

An electrostatically atomizing device includes an emitter electrode, an opposed electrode disposed in an opposed relation to the emitter electrode, liquid supply means for supplying a liquid to the emitter electrode, and high voltage generating means for applying a high voltage across the emitter electrode and the opposed electrode. The liquid supplied onto the emitter electrode is electrostatically charged through application of the high voltage, as a result of which charged minute liquid particles are discharged from a discharge end of the emitter electrode. The device includes detecting means for detecting a discharge condition developed between the emitter electrode and the opposed electrode, and a controller for controlling the high voltage generating means to regulate its voltage output so as to maintain a predetermined discharge condition, based on detection results by the detecting means. Charged minute particles can be continuously generated in an amount corresponding to the predetermined discharge condition, by adjusting the discharge voltage that is applied to the emitter electrode.

9 Claims, 4 Drawing Sheets

U.S. PATENT DOCUMENTS

| | | | | |
|---|---|---|---|---|
| 5,948,483 | A * | 9/1999 | Kim et al. | 427/483 |
| 6,060,128 | A * | 5/2000 | Kim et al. | 427/483 |
| 2002/0190203 | A1 | 12/2002 | Valaskovic et al. | |
| 2003/0164417 | A1* | 9/2003 | Balachandran et al. | 239/690 |
| 2004/0173743 | A1 | 9/2004 | Valaskovic et al. | |
| 2005/0178974 | A1 | 8/2005 | Sobek et al. | |
| 2005/0244811 | A1* | 11/2005 | Soundarrajan et al. | 435/4 |
| 2006/0118714 | A1 | 6/2006 | Sobek et al. | |
| 2008/0130189 | A1 | 6/2008 | Kobayashi et al. | |

FOREIGN PATENT DOCUMENTS

| | | | |
|---|---|---|---|
| JP | 2002-355582 | A | 12/2002 |
| JP | 2006-122759 | A | 5/2006 |
| JP | 2006-122819 | A | 5/2006 |
| WO | WO-02/095362 | A2 | 11/2002 |
| WO | WO-2005/097339 | A1 | 10/2005 |

OTHER PUBLICATIONS

Notification of Reasons for Refusal for the Application No. 2006-160174 from Japan Patent Office mailed Feb. 23, 2010.

Supplementary European Search Report for the Application No. EP 07 74 3850 dated Mar. 24, 2011.

* cited by examiner

ELECTROSTATICALLY ATOMIZING DEVICE

TECHNICAL FIELD

The present invention relates to an electrostatically atomizing device for generating nanometer-size mist.

BACKGROUND

International Patent Publication No. WO2005/097339 discloses a conventional electrostatically atomizing device for generating charged minute particles of nanometer size (nanometer-size mist). In the device, a high voltage is applied across an emitter electrode, supplied with water, and an opposed electrode, to induce Rayleigh breakup of the water held on the emitter electrode, thereby atomizing the water. The charged minute water particles thus obtained, long-lived and containing radicals, can be diffused into a space in large amounts. These water particles can thus act effectively on malodorous components adhered to indoor walls, clothing, or curtains, to deodorize the same. The device comprises cooling means for cooling the emitter electrode and forming thereby condensed water on the emitter electrode, out of air moisture; and a controller for detecting a discharge current flowing between the electrodes and for controlling the cooling means in such a way so as to maintain the discharge current at a predetermined value, while keeping the discharge voltage applied between the emitter electrode and the opposed electrode at a predetermined value.

However, continued generation of nanometer-size charged minute particles on the basis of a control scheme whereby the discharge voltage is kept at a predetermined value, while supplying a predetermined amount of a liquid to the emitter electrode by controlling the cooling temperature of the emitter electrode in such a manner that the discharge current takes on a predetermined value, is problematic in that there elapses a long response time between detection of the discharge current and generation of condensed water through cooling of the emitter electrode.

DISCLOSURE OF THE INVENTION

In the light of the above problems, it is an object of the present invention to provide an electrostatically atomizing device that allows generating a mist of nanometer-size charged minute particles, continuously and stably, by adjusting the discharge voltage instead of by controlling the amount of supplied liquid.

The electrostatically atomizing device according to the present invention includes an emitter electrode, an opposed electrode disposed in an opposed relation to the emitter electrode, liquid supply means for supplying a liquid to the emitter electrode, and high voltage generating means for applying a high voltage across the emitter electrode and the opposed electrode. The liquid supplied onto the emitter electrode is electrostatically charged through application of the high voltage, as a result of which charged minute liquid particles are discharged from a discharge end of the emitter electrode. The device includes detecting means for detecting a discharge condition developed between the emitter electrode and the opposed electrode, and a controller for controlling the high voltage generating means to regulate its voltage output so as to maintain a predetermined discharge condition, based on detection results by the detecting means. The predetermined discharge condition is therefore a discharge condition under which a predetermined amount of nanometer-size charged minute particles are generated. The predetermined discharge condition is maintained at all times, whereby charged minute particles can be generated, continuously and stably, by adjusting the discharge voltage that is applied to the emitter electrode, without significantly affecting the amount of liquid supplied to the emitter electrode.

Preferably, the above-described predetermined discharge condition is determined on the basis of a discharge current flowing between the emitter electrode and the opposed electrode. The detecting means detects then the discharge current, and the controller, having been given a target value of the discharge current that defines the predetermined condition, performs feedback control of the high voltage generating means so that the detected current takes on the predetermined value.

Preferably, the electrostatically atomizing device further includes target value setting means for selecting the target value within a predetermined range. The amount of nanometer-size charged minute particles generated can be adjusted thereby.

The target value range can be set to zero, i.e. to a value for which no discharge current is generated. Herein, the controller can set the voltage output of the high voltage generating means to zero and can stop the device by way of the target value setting means.

BEST MODE FOR CARRYING OUT THE INVENTION

The electrostatically atomizing device according to the present invention generates a mist of nanometer-scale negatively charged minute particles. Hence, releasing this mist into a target space allows deodorizing, sterilizing and decomposing substances that are present in that space. In the present invention, nanometer scale denotes a size from 3 nm to 100 nm.

Figure 1:
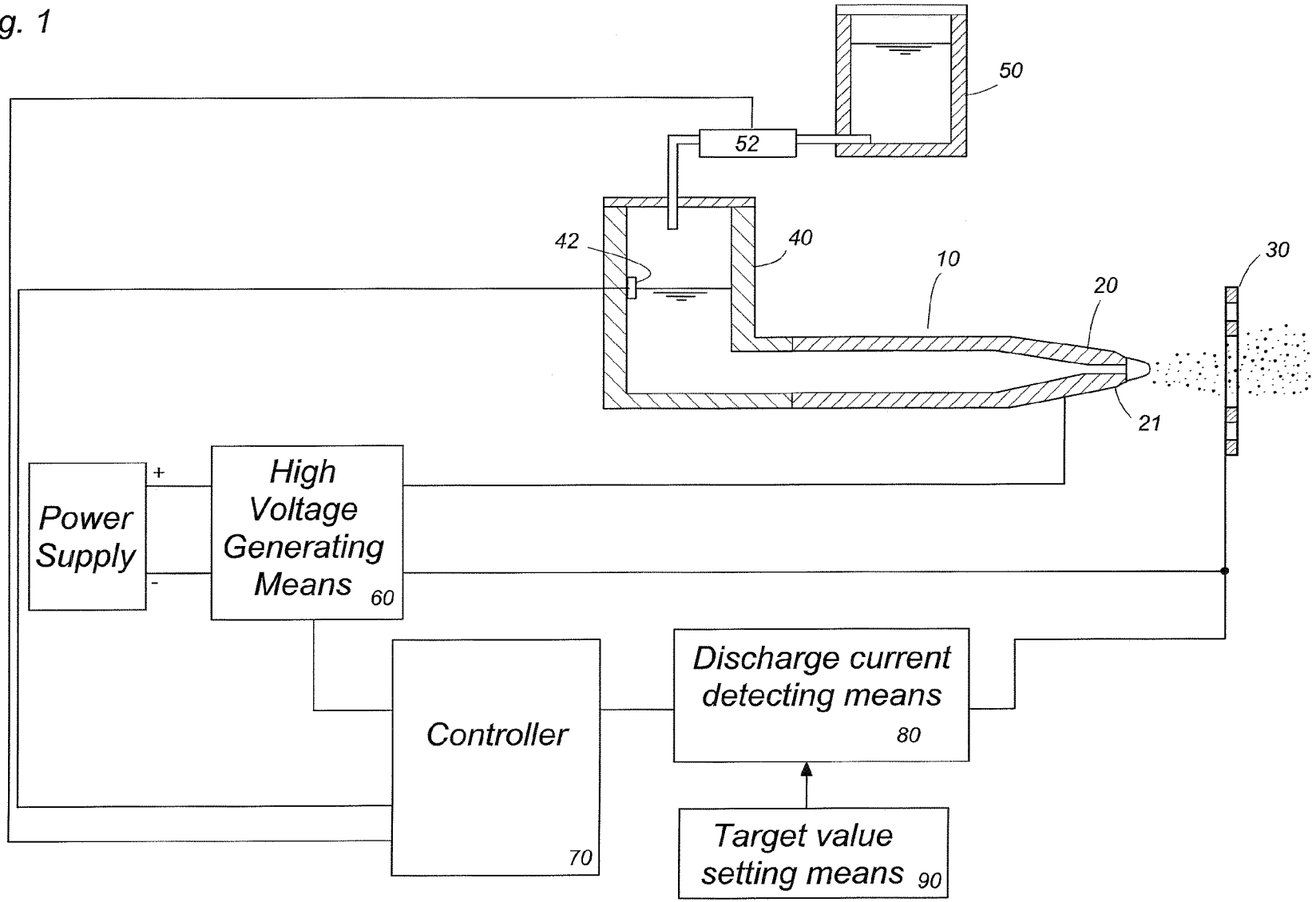
FIG. 1 is a block diagram of an electrostatically atomizing device according to an embodiment of the present invention.

As illustrated in FIG. 1, an electrostatically atomizing device according to an embodiment of the present invention comprises an atomizing nozzle 10 having an emitter electrode 20 at the tip; an opposed electrode 30 disposed opposite the emitter electrode 20; a high voltage generating means 60 for applying high voltage between the emitter electrode 20 and the opposed electrode 30; and a controller 70 for controlling the value of the high voltage. A pressure tank 40 is connected to the rear end of the atomizing nozzle 10. A liquid such as water, stored in the pressurizing tank 40, is supplied via the atomizing nozzle 10 to a discharge end 21 at the tip of the emitter electrode 20. The pressure tank 40 constitutes a liquid supply means that supplies a liquid to the emitter electrode 20. Although the electrostatically atomizing device of the present invention can be used for various kinds of liquids other than water, the present embodiment will be explained on the basis of an example in which water is used as the liquid.

The water supplied to the tip of the emitter electrode 20 forms droplets on account of surface tension. When high voltage, for instance a negative potential of −8 kV, is applied to the emitter electrode 20, there forms a high-voltage electric field between the opposed electrode 30 and the discharge end of the emitter electrode 20. The droplets become thus electrostatically charged, and are discharged, from the tip of the emitter electrode, as a mist M of minute water particles negatively charged. When high voltage is applied between the emitter electrode 20 and the opposed electrode 30, Coulomb forces come into being between the water held at the tip of the emitter electrode 20 and the opposed electrode 30, whereupon a Taylor cone TC forms through local rising of the water surface. Charge concentrates then at the tip of the Taylor cone TC, thereby increasing electric field strength in that section, where the generated Coulomb forces become greater, causing the Taylor cone TC to grow further. When these Coulomb forces exceed the surface tension of water W, the Taylor cone breaks apart (Rayleigh breakup) repeatedly, generating in the process a large amount of a mist of nanometer-size charged water minute particles. This mist rides the air stream, resulting from ion wind, that flows from the emitter electrode 20 towards the opposed electrode 30, and is discharged through the latter.

A pump 52 replenishes water to the pressure tank 40 from a replenishing tank 50. The water level in the pressure tank 40 is controlled to be kept constant at all times, to deliver a constant hydraulic head in the water supplied to the tip of the emitter electrode 20. To this end, a level sensor 42 is provided at the pressure tank 40. The controller 70 controls the pump 52 so as to keep constant at all times the water level detected by the level sensor 42.

The atomizing nozzle 10 is formed as a tube. The leading end of the atomizing nozzle 10, which forms the emitter electrode 20, is a capillary tube. The inner diameter of the portion of the atomizing nozzle 10 that extends from the pressure tank 40, at the rear end, up to the emitter electrode 20, at the leading end, is set in such a manner so as to preclude capillarity, and in such a manner that hydraulic head acts on the water droplets supplied to the tip of the emitter electrode 20. The inner diameter of the atomizing nozzle 10 decreases gradually towards the leading end thereof, where the atomizing nozzle 10 forms a capillary tube. At the tip of the emitter electrode, the water is formed into droplet by the surface tension. The hydraulic head is set to a value that does not hinder formation of water droplets by surface tension. This hydraulic head acts on the Taylor cone TC formed through application of high voltage.

It is found that, with water supplied to the emitter electrode 20, the discharge current flowing between the emitter electrode 20 and the opposed electrode 30 increases as the voltage applied between the two electrodes becomes greater. Keeping the discharge current at a predetermined value allows generating a predetermined amount of mist of nanometer-size charged minute particles. Specifically, the Taylor cone formed at the discharge end of the tip of the emitter electrode 20 expands, and the amount of charged minute particles increases, as the discharge current becomes larger. The present invention aims at generating stably a predetermined amount of mist of charged minute particles on the basis of the above relationship. In the present invention, the discharge voltage is adjusted in such a manner that the discharge current is kept at a predefined discharge condition, namely to a value set as a target value, to control thereby the generation of mist of charged minute particles in an amount prescribed by a target value.

In the present embodiment, therefore, there is provided a discharge current detecting means 80 for detecting the discharge current flowing from the emitter electrode 20 into the opposed electrode 30, and for outputting the value of the discharge current to the controller 70, as illustrated in FIG. 1. The controller 70, which is given a predetermined target value, sends to the high voltage generating means 60 a control output for adjusting the discharge voltage that is outputted by the high voltage generating means 60. On the basis of the detected discharge current, the discharge voltage is changed through feedback control to match thereby the discharge current to the target value.

The target value can be modified by a target value setting means 90, to adjust the generation amount of mist of charged minute particles that are discharged by the emitter electrode 20.

Figure 2:
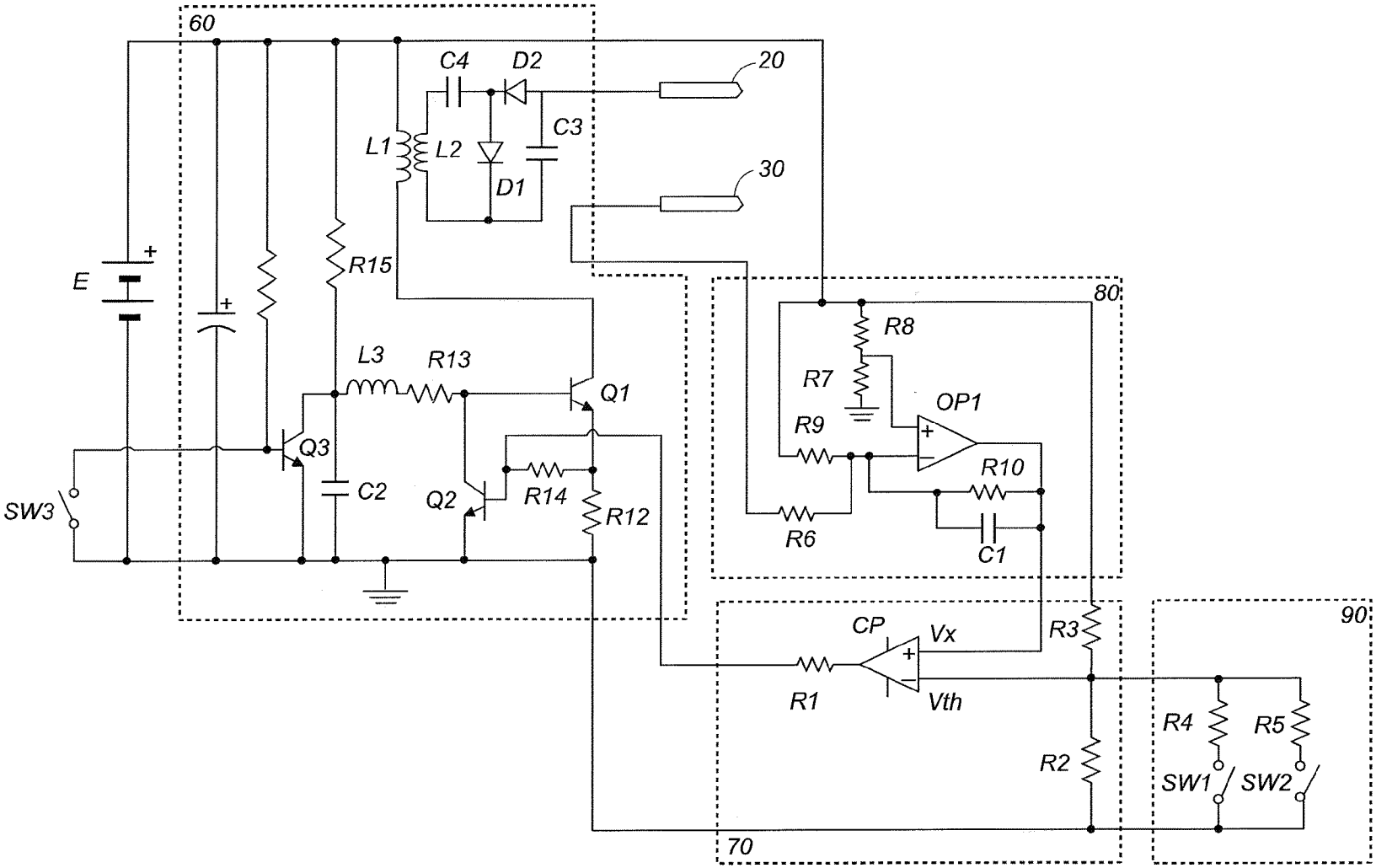
FIG. 2 is a circuit diagram illustrating a high voltage generating means, a controller and a discharge current detecting means used in the electrostatically atomizing device.

FIG. 2 illustrates an electric circuit for realizing the above-described high voltage generating means 60, discharge current detecting means 80, controller 70 and target value setting means 90. The high voltage generating means 60, comprising a well-known isolated DC-DC converter, is provided with an isolation transformer and a switching element Q1. The switching element Q1 is connected in series to a resistor R2 and a primary winding L1 of an isolation transformer, between both ends of a DC power supply E. A voltage doubler rectifier circuit comprising diodes D1, D2 and capacitors C3, C4 is connected to a secondary winding L2 of the isolation transformer. An auxiliary winding L3 of the isolation transformer is connected in series to a resistor R13, between the base of the switching element Q1 and the connecting point of a capacitor C2 and a resistor R15 that is connected in series between the two ends of the DC power supply E. A switching element Q2 for control is connected between the base and the emitter of the switching element Q1. The base of the switching element Q2 is connected to the connecting point of the emitter of the switching element Q1 and the resistor R12, via a resistor R14.

When the switching element Q1 is switched on, voltage rises between the ends of the resistor R12 as a result of current flowing into the primary winding L1 of the isolation transformer. Thereupon, the switching element Q2 switches on and the switching element Q1 switches off, in response to which the switching element Q2 switches off as well. Thereafter, voltage is induced in the auxiliary winding L3 on account of induced voltage generated in the secondary winding L2 of the isolation transformer. As a result, the base potential of the switching element Q1 rises, whereby the switching element Q1 switches on. High voltage is induced between both ends of the secondary winding L2 through repeated switching on and off of the switching element Q1. The induced voltage is applied between the emitter electrode 20 and the opposed electrode 30.

The output voltage of the high voltage generating means 60, i.e. the discharge voltage, is controlled by the control output of the controller 70. This control output is applied to the base of the switching element Q2, to change the timing at which the switching element Q2 switches on, and modify thereby the voltage induced in the secondary winding L2. That is, the voltage induced in the secondary winding L2 raises when the timing at which the switching element Q2 switches on is delayed. Conversely, the voltage induced in the secondary winding L2 drops when the timing at which the switching element Q2 switches on is brought forward.

Herein, a switching element Q3, for operation stop, is connected in parallel to the capacitor C2. High voltage can be generated by switching the switching element Q1 only when the switching element Q3 switches off through opening of a switch SW3 that is connected between the base-emitter. While the switching element Q3 is on and the switch SW3 is closed, the switching element Q1 is normally off. Therefore, the operation of the high voltage generating means is disabled. A control circuit (not shown) of an electric device (for instance, an air purifier, refrigerator or the like) installed in the electrostatically atomizing device of the present embodiment switches the switch SW3 on and off, i.e. switches between operation and stop of the high voltage generating means 60.

Figure 3:
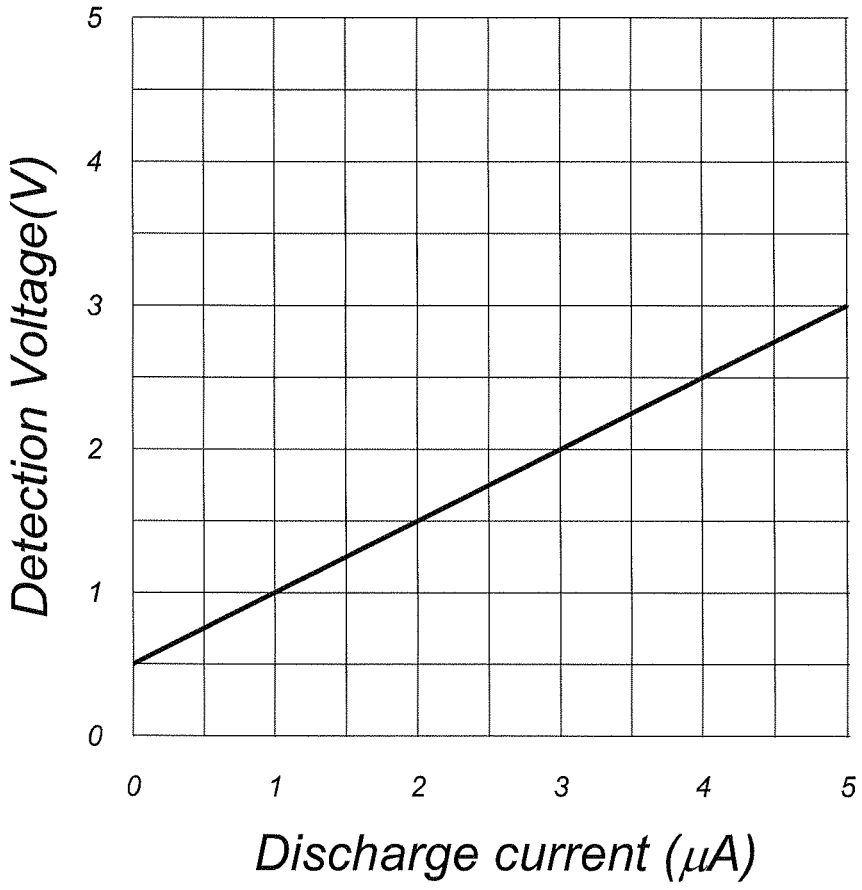
FIG. 3 is a graph diagram illustrating the relationship between discharge current and corresponding detection voltage in the electrostatically atomizing device.

The discharge current detecting means 80 is configured as a current-voltage converter using an op-amp OP1. To an inverting input terminal of the op-amp OP1 there is connected a positive electrode of the DC power supply E, via a resistor R9, and the opposed electrode 30, via a resistor R6. A reference current flowing from the DC power supply E via the resistor R9, and the discharge current flowing from the opposed electrode 30 via the resistor R6 are added into a current that flows into a resistor R10 connected between an output terminal and the inverting input terminal of the op-amp OP1. As a result, the output terminal of the op-amp OP1 outputs a detection voltage Vx that is directly proportional to the input current (discharge current) inputted to the inverting input terminal (see FIG. 3). A capacitor C1 is connected in parallel to the resistor R10, to speed up the response of the output voltage. A detection voltage (offset voltage), directly proportional to a reference voltage, is outputted also when the discharge current is zero, by inputting into the non-inverting input terminal of the op-amp OP1 a reference voltage resulting from dividing the power supply voltage of the DC power supply E by way of voltage-dividing resistors R7, R8.

The controller 70 comprises a comparator CP that compares the detection voltage Vx, outputted by the discharge current detecting means 80, with a threshold voltage Vth that is a target value of the discharge current to be generated, and which results from dividing the power supply voltage of the DC power supply E by way of resistors R2 and R3. The comparator CP feeds the control output to the base of the switching element Q2 of the high voltage generating means 60, via a resistor R1. When the detection voltage Vx exceeds the threshold voltage Vth and the output of the comparator CP reaches thus a high level, current flows into the base of the switching element Q2, and the switching-on timing of the switching element Q2 is brought forward. As a result, the switching-off timing in the switching element Q1 is brought forward, whereby the voltage induced at the secondary winding L2 drops. Accordingly, the output of the high voltage generating circuit 3 drops, and the discharge current is reduced. On the other hand, when the detection voltage Vx is lower than the threshold voltage Vth and the output of the comparator CP reaches thus a low level, current ceases to flow from the controller 70 into the base of the switching element Q2 via the resistor R1. The switching-off timing of the switching element Q1 is delayed as a result, whereby the voltage induced at the secondary winding L2 rises. Accordingly, the output of the high voltage generating means 60 rises and the discharge current is increased. That is, the controller 70 performs feedback control of the discharge voltage of the high voltage generating means 60 in such a manner so as to cancel the difference between the threshold voltage Vth and the detection voltage detected by the discharge current detecting means 80. A mist of a constant amount of charged minute particles can be generated stably by keeping the discharge current, flowing between the emitter electrode 20 and the opposed electrode 30, at the target value.

The target value setting means 90 comprises a series circuit of a switch SW1 and a voltage-dividing resistor R4, and a series circuit of a switch SW2 and a voltage-dividing resistor R5. Each series circuit is connected in parallel to the voltage-dividing resistor R2 of the controller 70. The amount of charged minute water particles that is generated can be varied by selecting a target value of the discharge current within a predetermined range, i.e. by selecting the threshold voltage Vth that is inputted to the comparator CP, through a combination of switching-on and off of the switches SW1, SW2.

If the target value setting means 90 can set, as the threshold voltage Vth, a voltage no greater than above-described offset voltage (detection voltage applied to the comparator when the discharge current is zero), then the output of the comparator CP is a high-level output at all times, the switching element Q2 is normally on and the switching operation of the switching element Q1 can be prohibited, to stop thereby the high voltage generating means 60. In this case the switching element Q3 and the switch SW3, for switching between operation and stop of the high voltage generating means 60, can be omitted, which allows reducing the number of components.

Figure 4:
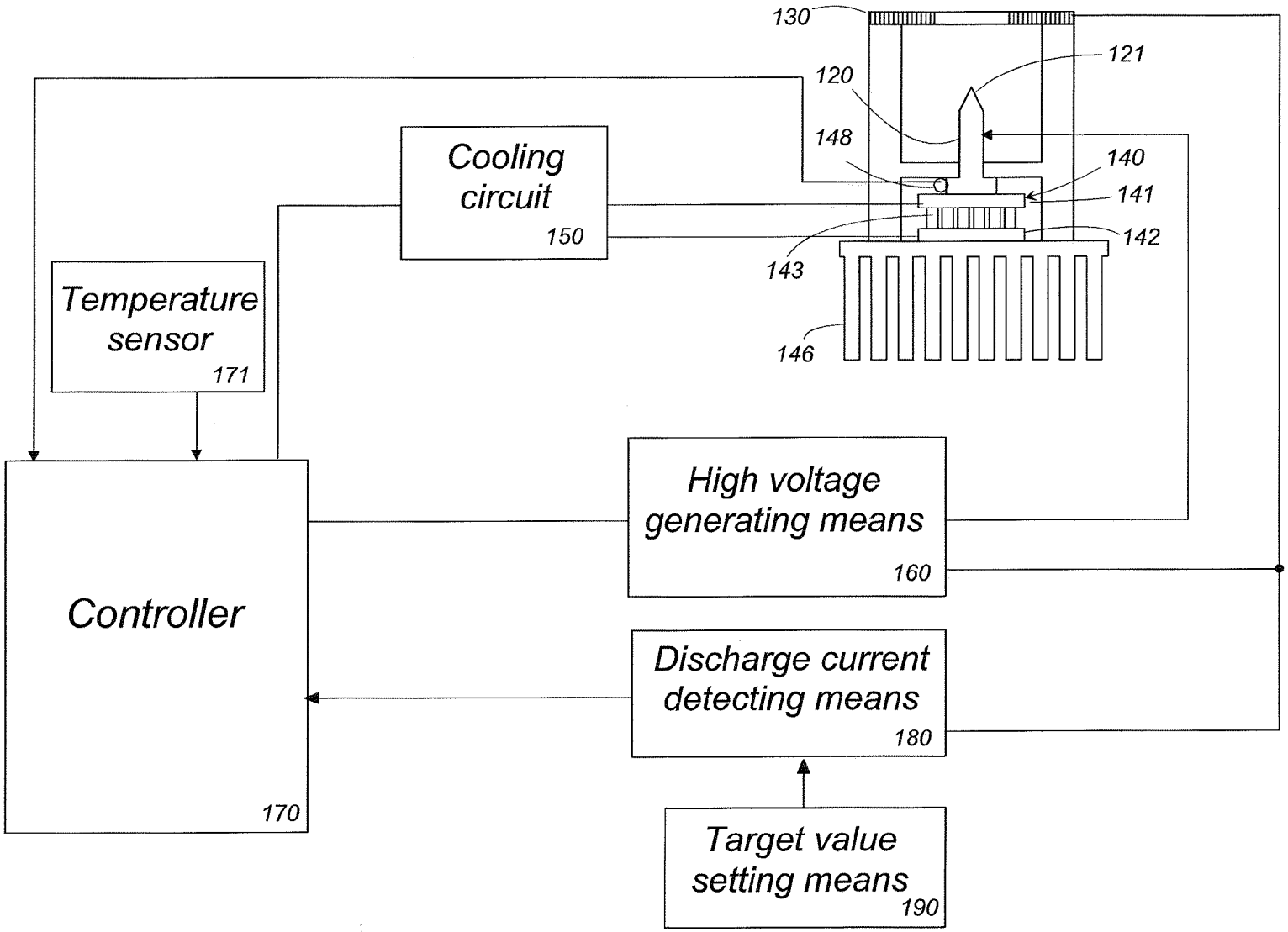
FIG. 4 is a block diagram of an electrostatically atomizing device according to another embodiment of the present invention.

FIG. 4 illustrates another embodiment of the electrostatically atomizing device of the present invention. The means used for supplying water to an emitter electrode 120 is herein a cooler that cools the emitter electrode 120 to condense thereon water out of surrounding air moisture. The electrostatically atomizing device of the present embodiment comprises the emitter electrode 120 and an opposed electrode 130 disposed opposite the emitter electrode 120. The opposed electrode 130 comprises a circular hole 132 formed on a substrate made of a conductive material. The inner peripheral edge of the circular hole stands at a predetermined distance from a discharge end 121 at the tip of the emitter electrode 120. The device comprises a high voltage generating means 160 and a cooler 140 coupled to the emitter electrode 120, for cooling the latter. The cooler 140 supplies water to the emitter electrode 120 by cooling the emitter electrode 120, to condense thereon water vapor that is present in the surrounding air. The high voltage generating means 160 applies a high voltage between the emitter electrode 120 and the opposed electrode 130, thereby electrostatically charging water on the emitter electrode 120 and causing the water to be atomized, out of the discharge end, in the form of charged minute particles.

The cooler 140 comprises a Peltier module. The cooling side of the Peltier module is coupled to the end of the emitter electrode 120, on the opposite side to the discharge end 121. Applying a predetermined voltage to the thermoelectric elements of the Peltier module causes the emitter electrode to be cooled to a temperature not higher than then dew point of water. The Peltier module comprises a plurality of thermoelectric elements 143 connected in parallel between heat conductors 141, 142. The Peltier module cools the emitter electrode 120 at a cooling rate that is determined by a variable voltage applied by a cooling power supply circuit 40. One heat conductor 141, the one at the cooling side, is coupled to the emitter electrode 120, while the other heat conductor 142, the one at the heat-dissipating side, has formed thereon heat-dissipating fins 146. The Peltier module is provided with a thermistor 148 for detecting the temperature of the emitter electrode 120.

The high voltage generating means 160, which is configured as in the above-described embodiment, applies a predetermined high voltage between the emitter electrode 120 and the opposed electrode 130 connected to ground. The high voltage generating means applies a negative or positive voltage (for instance, −4.6 kV), to the emitter electrode 120.

As is the case in the above-described embodiment, the electrostatically atomizing device of the present embodiment comprises a discharge current detecting means 180, a target value setting means 190 and a controller 170.

In addition to controlling the voltage output of the high voltage generating means 160 in such a manner that the detected discharge current takes on the target value selected by the target value setting means 190, the controller 170 adjusts also the cooling temperature of the emitter electrode 120, which is cooled by the Peltier module, by controlling a cooling circuit 150. To this end, the controller 170 is connected to a thermistor 148 and a temperature sensor 171 for detecting the temperature of the indoor environment. The controller 170 adjusts the temperature of the emitter electrode 120 in accordance with the environment temperature, to maintain thereby an adequate amount of condensed water on the emitter electrode 120.

In the present embodiment as well, the discharge voltage is feedback-controlled, on the basis of detected discharge current, in such a manner that the discharge current takes on a target value, to allow thereby generating a mist of charged minute particles in an amount prescribed by a target value. A mist of an appropriate amount of charged minute particles can thus be generated stably without controlling rigorously the cooling temperature.

The invention claimed is:

1. An electrostatically atomizing device comprising:

an emitter electrode;

an opposed electrode disposed in an opposed relation to said emitter electrode;

a liquid supply means configured to supply a liquid to said emitter electrode; and a high voltage generating means which applies a high voltage across said emitter electrode and said opposed electrode to develop an electrical discharge between said electrodes in order to electrostatically charge said liquid on said emitter electrode, thereby discharging charged minute liquid particles from a discharge end of said emitter electrode, wherein a detecting means is provided to detect a discharge condition developed between said emitter electrode and said opposed electrode, and a controller is provided to control said high voltage generating, means to regulate its high voltage output in order to maintain a predetermined discharge between said electrodes based upon the detected discharge condition, wherein said liquid supply means for supplying water to said emitter electrode is a cooler said configured to cool said emitter electrode to condense thereon water out of surrounding air moisture, and wherein said detecting means is configured to detect a discharge current flowing between said emitter electrode and said opposed electrode, and said controller is configured to give a feedback control of controlling said high voltage generating means to keep the detected discharge current at a target value.

2. An electrostatically atomizing device as set forth in claim 1, further including:

a target value setting means which selects said target value within a predetermined range.

3. An electrostatically atomizing device as set forth in claim 2, wherein said predetermined range includes a zero, and said controller controls to stop said high voltage generating means from proving the voltage output in response to the selection of zero as said target value at said target value setting means.

4. An electrostatically atomizing device as set forth in claim 1, wherein said detecting means is connected to said opposed electrode.

5. An electrostatically atomizing device as set forth in claim 1, wherein said controller is configured to compare a detection voltage corresponding to the discharge current with a threshold voltage corresponding to the target value, said controller being configured to reduce the discharge current by making output voltage of the high voltage generating means drop when the detection voltage exceeds the threshold voltage, and configured to increase the discharge current by making the output voltage of the high voltage generating means rise when the detection voltage is lower than the threshold voltage.

6. An electrostatically atomizing device as set forth in claim 1, wherein said controller is configured to give the feedback control of controlling said high voltage generating means so that the electrostatically atomizing device generates a mist of nanometer-size charged water particles continuously and stably.

7. An electrostatically atomizing device as set forth in claim 1, wherein said detecting means is configured to detect a discharge current flowing between said emitter electrode and said opposed electrode and flowing from the opposed electrode via a resistor, and said controller is configured to give a feedback control of controlling said high voltage generating means to keep the detected discharge current at a target value.

8. An electrostatically atomizing device as set forth in claim 1, wherein said detecting, means is configured as a current-voltage converter, said detecting means being configured to detect a discharge current flowing between said emitter electrode and said opposed electrode and flowing from the opposed electrode via a resistor, and said detecting means being configured to output a detection voltage that is proportional to the discharge current, and said controller is configured to perform iced back control of the discharge voltage of the high voltage generation means in such a manner so as to cancel the difference between a threshold voltage and the detection voltage to give a feedback control of controlling said high voltage generating means to keep the detected discharge current at a target value.

9. An electrostatically atomizing device as set forth in claim 1, wherein said detecting means is configured to detect a level of the discharge current flowing between said emitter electrode and said opposed electrode, and said controller is configured to give a feedback control of controlling said high voltage generating means to keep the level of the detected discharge current at a target value.

* * * * *